US009725834B2

(12) United States Patent
Gielen

(10) Patent No.: US 9,725,834 B2
(45) Date of Patent: Aug. 8, 2017

(54) METHOD AND DEVICE FOR MEASURING THE FABRIC TENSION IN A WEAVING MACHINE

(71) Applicant: Lindauer DORNIER GmbH, Lindau (DE)

(72) Inventor: Markus Gielen, Lindau (DE)

(73) Assignee: Lindauer DORNIER GmbH, Lindau (DE)

( * ) Notice: Subject to any disclaimer, the term of this patent is extended or adjusted under 35 U.S.C. 154(b) by 0 days.

(21) Appl. No.: 15/032,880

(22) PCT Filed: Nov. 6, 2014

(86) PCT No.: PCT/EP2014/073946
§ 371 (c)(1),
(2) Date: Apr. 28, 2016

(87) PCT Pub. No.: WO2015/067702
PCT Pub. Date: May 14, 2015

(65) Prior Publication Data

US 2016/0281278 A1 Sep. 29, 2016

(30) Foreign Application Priority Data

Nov. 7, 2013 (DE) ..... 10 2013 222 679

(51) Int. Cl.
*D03D 49/12* (2006.01)
*D03D 49/18* (2006.01)
(Continued)

(52) U.S. Cl.
CPC ..... *D03D 49/18* (2013.01); *D03D 49/22* (2013.01)

(58) Field of Classification Search
CPC ..... D03D 49/06; D03D 49/04; D03D 49/12; D03D 49/18; D03D 49/22
See application file for complete search history.

(56) References Cited

U.S. PATENT DOCUMENTS 3,526,252 A * 9/1970 Hindle ..... D03D 49/06 139/110
3,878,872 A * 4/1975 Hintsch ..... D03D 49/06 139/110
(Continued)

FOREIGN PATENT DOCUMENTS

DE 2 248 558 4/1974
DE 39 05 881 9/1990
(Continued)

OTHER PUBLICATIONS

International Search Report of the International Searching Authority for International Application PCT/EP2014/073946, mailed Mar. 5, 2015, 2 pages, European Patent Office, HV Rijswijk, Netherlands.
(Continued)

*Primary Examiner* — Bobby Muromoto, Jr.
(74) *Attorney, Agent, or Firm* — W. F. Fasse

(57) ABSTRACT

Method for measuring the fabric tension in a weaving machine, in which the fabric (1) is deflected by a deflecting shaft (2), wherein a bending force is applied onto the deflecting shaft (2) by the fabric (1). The flexure or bending displacement of the deflecting shaft (2) is measured by a sensor (3), which is arranged in an area between two supports (4.1, 4.2) of the deflecting shaft (2) on the weaving machine. The deflecting shaft (2) is connected with a machine frame (9) of the weaving machine via the two supports (4.1, 4.2). The spacing distance (A) between the two supports (4.1, 4.2) of the deflecting shaft (2) is reduced for larger fabric tensions to be measured and is increased for smaller fabric tensions to be measured. Furthermore, the invention relates to a corresponding weaving machine.

14 Claims, 3 Drawing Sheets

A - A

(51) Int. Cl.
*D03D 49/22* (2006.01)
*D03D 49/04* (2006.01)

(56) References Cited

U.S. PATENT DOCUMENTS 4,572,243 A * 2/1986 Felix ..... G01L 5/042 139/110
4,690,176 A * 9/1987 Thalmann ..... D03D 49/22 139/110
4,942,908 A * 7/1990 Imamura ..... D03D 49/04 139/1 E
5,025,837 A * 6/1991 Gielen ..... D03D 49/04 139/35
5,355,912 A * 10/1994 Corain ..... D03D 49/18 139/110
5,628,346 A * 5/1997 Corain ..... D03D 49/04 139/110
5,722,464 A * 3/1998 Truyen ..... C12Q 1/6806 139/25
6,311,737 B2 * 11/2001 Wahhoud ..... D03D 49/10 139/50
7,077,168 B2 * 7/2006 Herrlein ..... B65H 59/24 139/194

FOREIGN PATENT DOCUMENTS

EP 0 100 394 2/1984
EP 0 590 725 3/2001

OTHER PUBLICATIONS

PCT International Preliminary Report on Patentability including English Translation of PCT Written Opinion of the International Searching Authority for International Application PCT/EP2014/073946, issued May 10, 2016, 7 pages, International Bureau of WIPO, Geneva, Switzerland.

* cited by examiner

A - A

METHOD AND DEVICE FOR MEASURING THE FABRIC TENSION IN A WEAVING MACHINE

TECHNICAL FIELD

The present invention relates to the measuring of a fabric tension in a weaving machine.

PRIOR ART

On weaving machines, methods and apparatuses with which the fabric tension can be measured are known in the prior art. Because the finished fabric, before it is rolled-up, is connected in a force-transmitting manner with the warp threads of the weaving machine, the measurement of the fabric tension can generally be utilized to regulate the warp tension during the weaving.

An apparatus of the mentioned type is shown, for example, by the EP 0 590 725 B1. There it is described that a deflecting shaft or a deflecting beam is supported at its outer ends, and that the flexure or bending of the deflecting shaft under the tension of the fabric is measured with a load cell or a sensor approximately in the middle between the supports.

The DE 3905881 A1 also shows an apparatus for measuring the warp tension with the aid of a sensor, which detects the fabric tension. In that regard, the sensor is embodied as a measuring beam that is integrated in the deflecting shaft.

However, it has been shown that the fabric or warp tensions to be measured can vary greatly depending on the type of fabric, and particularly in a ratio of 1:400. The measurement of flexures or bends, or fabric tensions in such a large range is, however, not possible with a single sensor. In practice that leads to the result that sensors are exchanged if fabrics are to be woven with greatly differing warp tensions.

It is an object of the present invention to provide a method with which fabric tensions can be measured in a very large tension range, without requiring an exchange of sensors for this.

DESCRIPTION OF THE INVENTION

The object is achieved by a method according to the independent claim 1 and by a weaving machine according to the independent claim 7.

For measuring the fabric tension, the fabric is deflected in the weaving machine by a deflecting shaft or a deflecting beam. Due to the deflection, a bending force is applied to the deflecting shaft by the fabric. Thereby, a larger or smaller flexure or bending of the deflecting shaft is caused, depending on the magnitude of the fabric or warp tension. The flexure or bending displacement of the deflecting shaft is measured by a sensor that is arranged in an area between two supports of the deflecting shaft on the weaving machine. The deflecting shaft is connected with a machine frame of the weaving machine via the two supports and via releasable connecting means. The sensor directs its measurement signals, for example, further to a controller of the weaving machine. The invention is characterized in that the spacing distance between the two supports of the deflecting shaft is reduced or is reducible for larger fabric tensions to be measured, and that the spacing distance between the two supports is increased or is increasable for smaller fabric tensions to be measured.

Especially preferably, the deflecting shaft is supported at its two outer ends by means of two stationary outer supports, whereby the two said supports that have a variable spacing distance are arranged between the two outer supports.

Most suitably, for varying the spacing distance, the connecting means between the two (inner) supports and the weaving machine are released and again secured. That can be achieved by the operator of the weaving machine or by automatically operating adjusting means, clamping and/or sliding devices (for example with spindle motors).

Various different measuring ranges are realized by differently sized spacing distances between the clamping locations of the deflecting shaft. Because the flexure or bending of a shaft that is clamped-in at both ends varies proportionally to the surface loading and over-proportionally to the spacing distance of the clamping-in locations, a large variance of the measuring ranges can be achieved with a small variance of the clamping-in length.

Preferably an inductive sensor is utilized for the measuring of the flexure or bending. But all other displacement measuring sensors (capacitive, optical, magnetic) can be utilized. In that regard, the measurement signal is picked-up or taken-off directly from the deflecting shaft or from a transmission element that is connected with the deflecting shaft.

A strain gage can also be used as a sensor, which is arranged, for example, on an elastically deformable transmission element that is connected with the deflecting shaft.

It is advantageous if an input device is provided, with which the operator can input an information regarding the current support spacing distance into the controller of the weaving machine, so that the controller can identify a measuring range in connection with the sensor sensitivity. Also conceivable is the direct input of the measuring range that results from a certain support spacing distance.

For supporting the input by the operator it is suitable that markings are provided on the weaving machine, from which the operator can obtain informations about the current support spacing distance or about the measuring range resulting from the support spacing distance.

It is advantageous if at least one measuring element is provided, which measures the current support spacing distance or at least one of the two support positions, and the measurement values are electrically provided further to the controller of the weaving machine. If only one of the two support positions is measured relative to a line of symmetry between both supports, then the actual support spacing distance can be determined.

With small amounts of flexure or bending and small tensions, problems can arise in the selection of economical sensors. Therefore it is especially advantageous if the flexure or bending displacement of the deflecting shaft is transmitted via a transmission element, for example a transmission lever, to the sensor in such a manner so that the displacement of the transmission element effective at the sensor is larger than the actual flexure or bending displacement on the deflecting shaft.

That can be achieved, for example, in that the sensor is arranged on the weaving machine with a certain spacing distance relative to the deflecting shaft, and that a transmission lever with two lever ends is provided between deflecting shaft and sensor. The first lever end of the transmission lever is connected with a machine frame of the weaving machine, while the second lever end is freely movable. The first lever end can be connected with the machine frame in a rotatable manner or via an elastically deformable element or an elastically deformable portion of the transmission lever. The transmission lever is arranged between the deflecting shaft and the sensor in such a manner so that the second end of the transmission lever lies closer to the sensor with respect to the spacing distance between transmission shaft and sensor, while the first lever end lies closer to the deflecting shaft. In that regard, a connection exists between deflecting shaft and transmission lever, via which the flexure or bending displacement of the deflecting shaft is transmitted to the transmission lever. For example, this connection can be a frictional force-transmitting connection in the form of a contact of the deflecting shaft on an elastically pre-tensioned transmission lever. However, a positive form-fitting or form-interlocking connection, for example via a hinge joint or a clamped connection, is also conceivable.

Through the described arrangement of the two lever ends with respect to the deflecting shaft, there arises a lever transmission that transmits small flexure or bending displacements on the deflecting shaft in the proximity of the first lever end, into larger flexure or bending displacements or measurement distances on the sensor in the proximity of the second lever end.

ADVANTAGEOUS EMBODIMENT OF THE INVENTION

Figure 1:
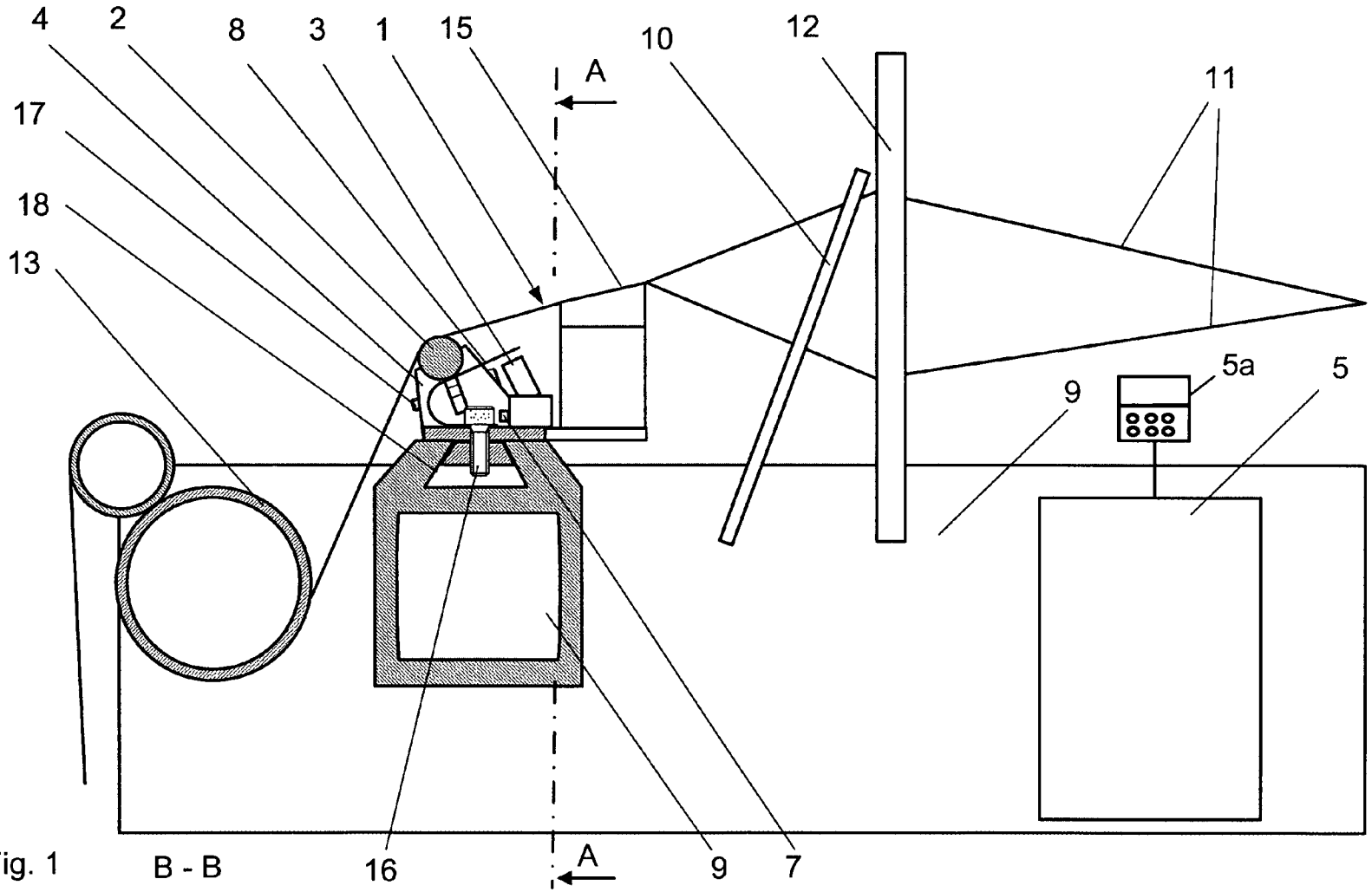
FIG. 1 schematic illustration of a weaving machine with an apparatus or device for carrying out the method according to the invention, view B-B.
Figure 2:
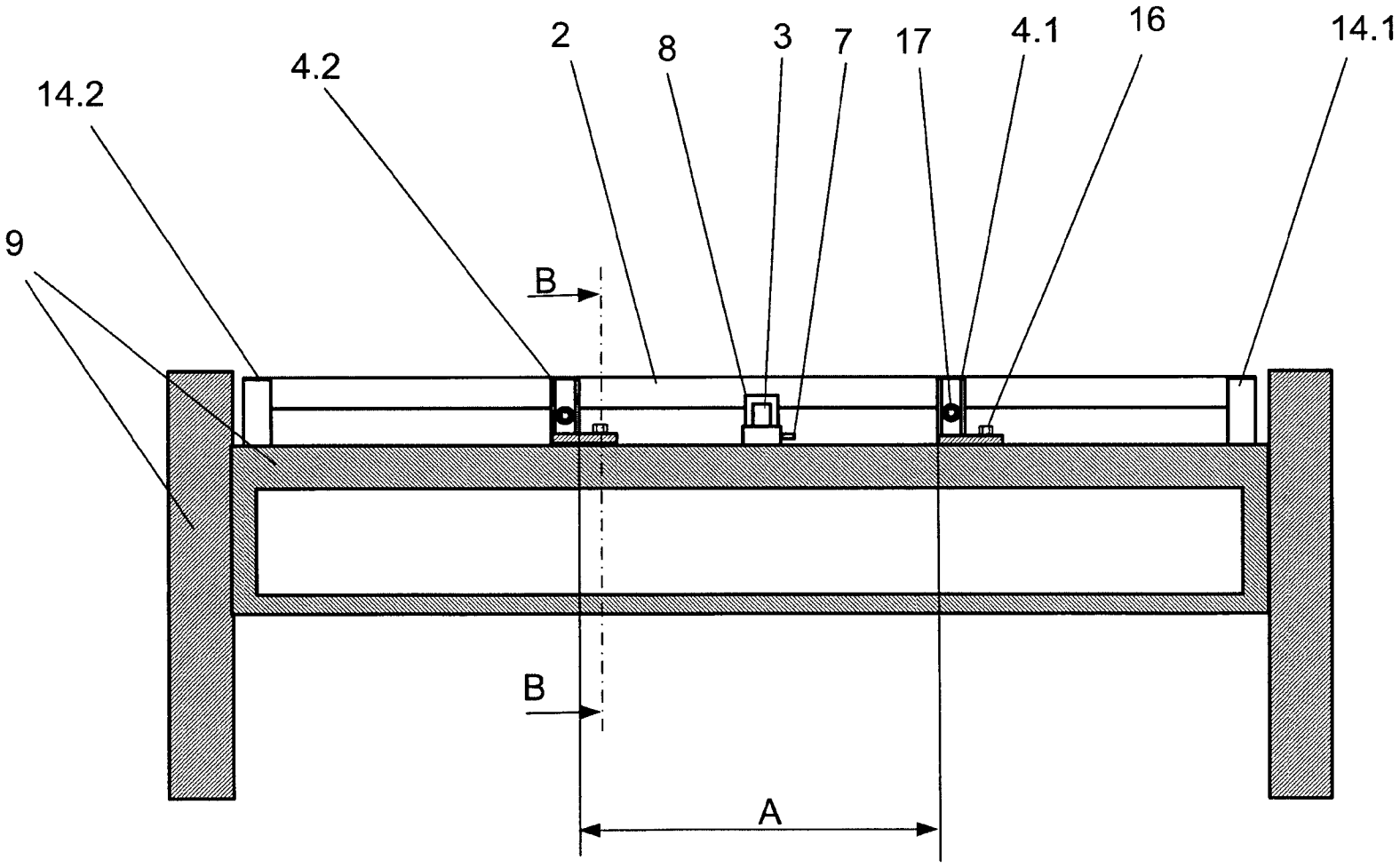
FIG. 2 view A-A of the weaving machine according to FIG. 1, however without fabric.
Figure 3:
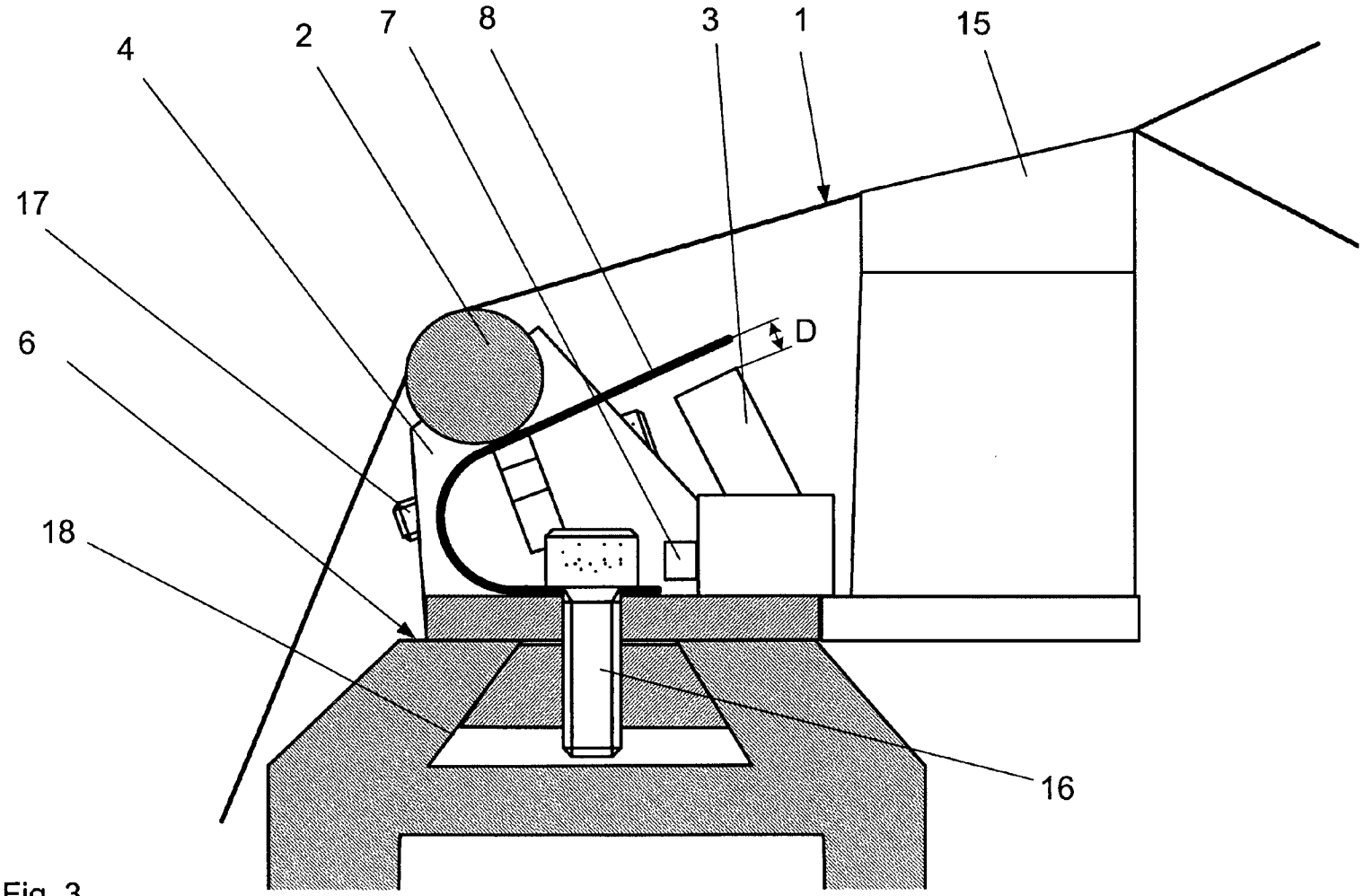
FIG. 3 enlarged cut-away portion of FIG. 1.

The FIGS. 1 to 3 will be described together in common in the following.

Warp threads 11 are drawn-off from a warp beam that is not illustrated, and are guided through shedding elements 12 in such a manner so that the warp threads 11 form a loom shed, into which a weft thread is inserted. The weft thread is beat-up by a weaving reed 10 against a fabric edge or interlacing point. The fabric 1 is delivered over a fabric table 15 and a deflecting shaft 2 to a feed or drawing-in roller 13. The deflecting shaft 2 can also comprise a threading or obliquely extending grooves, by which the fabric 1 is spread out in the weft direction. The deflecting shaft 2 is supported via two inner supports 4.1, 4.2 that are adjustable in the spacing distance relative to one another, and two stationary outer supports 14.1, 14.2 as well as a guide profile 18 in the machine frame 9 of the weaving machine.

The feed or drawing-in roller 13 and the warp beam are connected with drives that are not illustrated. These drives are actuated by the controller 5 of the weaving machine in such a manner so that the warp threads 11 and the fabric 1 connected with the warp threads 11 are tensioned in the warp direction. The magnitude of the fabric tension is a measure for the magnitude of the warp tension or the warp thread tension forces on the weaving machine.

Due to the deflection of the tensioned fabric 1 over the deflecting shaft 2 in an area between the two supports 4.1, 4.2, there arises a bending force that causes an elastic flexure or bending of the deflecting shaft 2. The deflecting shaft 2 is connected with a transmission lever 8, which enlarges the flexure or bending displacement or the magnitude of the elastic deformation of the deflecting shaft 2. In the present example, the transmission lever 8 consists of a bendable metal sheet that is clamped-in at its first end on the machine frame 9. The metal sheet comprises a curved or bent portion that acts like a bending spring. Thereby the transmission lever 8 is connected elastically at its first end with the machine frame 9. The second end of the metal sheet is freely movable, at least in the direction of the flexure or bending displacement of the deflecting shaft 2. The transmission lever 8 is arranged so that a flexure or bending of the deflecting shaft 2 leads to a sliding displacement of the transmission lever 8. Upon a flexure or bending of the deflecting shaft 2, respective sliding displacements of the transmission lever 8 that extend approximately in the shape of a circular arc, arise at the freely movable second end of the transmission lever 8 and at the point at which the deflecting shaft 2 engages on the transmission lever 8. The second end of the transmission lever 8 is spaced farther away from the clamping-in location on the machine frame 9 than the point or the area at which the deflecting shaft 2 is connected with the transmission lever 8. Through this arrangement, differently sized sliding displacements arise for the above described circular arc-shaped sliding displacements depending on the spacing distance of the connection location of the transmission lever 8 with the machine frame 9. The arrangement of the deflecting shaft 2, a sensor 3 that is explained further below, and the transmission lever 8 is selected so that a flexure or bending of the deflecting shaft 2 causes a larger sliding displacement at the free end of the transmission lever 8 than the sliding displacement at the point or in the area at which the deflecting shaft 2 is connected with the transmission lever 8.

The already mentioned sensor 3, which detects the measurement distance D of the free lever end in the direction of the flexure or bending of the deflecting shaft 2, is arranged in the proximity of the free second end of the transmission lever 8. Through the lever transmission ratio of the transmission lever 8, it is also possible to utilize such sensors 3 that only emit a measurement signal for larger measurement distances D, in the present example this is an inductive distance transducer. That is an element that causes lower costs than, for example, a high-sensitivity strain gage that could be secured directly on the bottom side of the deflecting shaft 2, in order to measure the very small strains that arise there as a result of the flexure or bending. The measured flexure or bending is a measure for the fabric tension or for the warp tension of the fabric 1 that is currently deflected over the deflecting shaft 2 in the weaving machine.

The actually arising flexure or bending of the deflecting shaft 2 is, however, also dependent on the spacing distance A of the supports 4.1, 4.2, between which the flexure or bending is measured.

In the present example, the supports 4.1, 4.2 are releasably connected via screws 16 with a cross-girder of the machine frame 9. By a sliding displacement of the supports 4.1, 4.2 in a guide profile 18 of the cross-girder, the operator can make the spacing distance A between the supports 4.1, 4.2 larger or smaller. As an auxiliary aid in this process, a measurement scale is applied on the guide profile. This measurement scale includes several markings 6, which are respectively brought into alignment with an edge of the respective support 4.1, 4.2 by the operator of the weaving machine, in order to adjustingly set various different spacing distances of the supports 4.1, 4.2 and therewith various different prescribed measuring ranges for the fabric tension to be measured, according to the invention.

The operator inputs the respective adjustingly set support spacing distance A into the weaving machine controller 5 via an input device 5*a* (e.g. touch panel). Then, in the controller 5, the signals of the sensor 3 corresponding to the adjusted spacing distance A are transformed by calculation into a flexure or bending or a fabric tension.

The markings 6 can also be embodied or configured so that the measuring range, that is to say a maximum value and minimum value of the fabric tension that arises from the adjusted support spacing distance A, is directly readable therefrom. In this case, the operator inputs the adjusted measuring range via the mentioned input device 5*a* directly into the controller 5 of the weaving machine.

Especially advantageous is an optional arrangement of one or more measuring elements 7 for the direct measurement of the support spacing distance A or for the measurement of the current spacing distance of one or both supports 4.1, 4.2 to the sensor 3. As an example, in FIGS. 1 to 3 a light emitter is illustrated as a measuring element 7. The light emitter 7 is arranged on the base body of the sensor 3 for the flexure or bending between the two supports 4.1, 4.2 of the deflecting shaft 2. The measuring element 7 measures the spacing distance to the support 4.1. For this purpose, suitably a reflector surface for the light beam of the light emitter 7 is present on this support 4.1. The other support 4.2 is adjustingly set by the operator symmetrically to the sensor 3 on the guide profile. Thus, the measured spacing distance of the one support 4.1 to the sensor 3 corresponds to half of the spacing distance A between the two supports. The measured spacing distance is conveyed electrically further to the weaving machine controller 5 and there is transformed by calculation into a measuring range for the fabric tension.

In the present example, the deflecting shaft 2 is secured with the aid of clamping jaws and clamping screws 17 on the supports 4.1, 4.2. A variation of the support spacing distance A is possible without thereby changing the position of the deflecting shaft 2 relative to the sensor 3 or relative to the weaving machine. The sensor 3 and the transmission lever 8 are similarly secured on the guide profile 18 of the machine frame 9.

REFERENCE NUMBERS

1 fabric
2 deflecting shaft
3 sensor for flexure or bending
4.1, 4.2 supports
5 controller of the weaving machine
5*a* input device
6 marking
7 measuring element for support spacing distance
8 transmission lever
9 machine frame
10 weaving reed
11 warp threads
12 shedding elements
13 feed or drawing-in roller
14.1, 14.2 outer supports
15 fabric table
16 screw connection of the supports
17 clamp screw for deflecting shaft
18 guide profile
A spacing distance between supports
D measurement distance

The invention claimed is:

1. Method for measuring the fabric tension in a weaving machine, in which the fabric (1) is deflected by a deflecting shaft (2), wherein a bending force is applied by the fabric (1) onto the deflecting shaft (2), and wherein the flexure or bending displacement of the deflecting shaft (2) is measured by a sensor (3), which is arranged in an area between two supports (4.1, 4.2) of the deflecting shaft (2) on the weaving machine, wherein the deflecting shaft (2) is connected with a machine frame (9) of the weaving machine via the two supports (4.1, 4.2), characterized in that the spacing distance (A) between the two supports (4.1, 4.2) of the deflecting shaft (2) is reduced for larger fabric tensions to be measured and is increased for smaller fabric tensions to be measured.

2. Method according to claim 1, wherein the two outer ends of the deflecting shaft (2) are additionally supported by two stationary outer supports (14.1, 14.2).

3. Method according to claim 1, wherein the operator inputs an information about the current spacing distance (A) between the two supports (4.1, 4.2) of the deflecting shaft (2) or about the current measuring range into the controller (5) of the weaving machine.

4. Method according to claim 1, wherein markings (6) are applied on the weaving machine, from which the operator can obtain informations about the current spacing distance (A) between the two supports (4.1, 4.2) of the deflecting shaft (2) or about the current measuring range.

5. Method according to claim 1, wherein the current spacing distance (A) between the two supports (4.1, 4.2) of the deflecting shaft (2) or the position of at least one support (4.1) is measured and electrically conveyed further to the controller (5) of the weaving machine by measuring elements (7).

6. Method according to claim 1, wherein the flexure or bending displacement of the deflecting shaft (2) is transmitted to the sensor (3) by a transmission element (8) in such a manner so that the measurement distance (D) of the transmission element (8) effective at the sensor (3) is larger than the actual flexure or bending displacement on the deflecting shaft (2).

7. Method according to claim 6, wherein a transmission lever (8) with two lever ends is used as the transmission element (8), wherein the first lever end is connected with a machine frame (9) of the weaving machine, while the second lever end is freely movable, and wherein the sensor (3) is arranged at a spacing distance from the deflecting shaft (2), while the transmission lever (8) is arranged between deflecting shaft (2) and sensor (3) in such a manner so that the second lever end of the transmission lever (8) lies closer to the sensor (3), while the first lever end lies closer to the deflecting shaft (2).

8. Weaving machine with a measuring device for measuring the fabric tension in a weaving machine, with a deflecting shaft (2) for deflecting the fabric (1), which applies a bending force onto the deflecting shaft (2), with a sensor (3) for measuring the flexure or bending displacement of the deflecting shaft (2), wherein the sensor (3) is arranged in an area between two supports (4.1, 4.2) of the deflecting shaft (2) on the weaving machine, and wherein the deflecting shaft (2) is connected with a machine frame (9) of the weaving machine via the two supports (4.1, 4.2), characterized in that the spacing distance (A) between the two supports (4.1, 4.2) of the deflecting shaft (2) is reducible for larger fabric tensions to be measured and increasable for smaller fabric tensions to be measured.

9. Weaving machine according to claim 8, characterized in that the two outer ends of the deflecting shaft (2) are additionally supported by two stationary outer supports (14.1, 14.2).

10. Weaving machine according to claim 8, characterized by an input device (5*a*) for the inputting of an information about the current spacing distance (A) between the two supports (4.1, 4.2) of the deflecting shaft (2) or about the current measuring range into the controller (5) of the weaving machine.

11. Weaving machine according to claim 8, characterized in that markings (6) are applied on the weaving machine, from which the operator can obtain informations about the current spacing distance (A) between the two supports (4.1, 4.2) of the deflecting shaft (2) or about the current measuring range.

12. Weaving machine according to claim 8, characterized by at least one measuring element (7), especially at least one light emitter, for measuring the current spacing distance (A) between the two supports (4.1, 4.2) of the deflecting shaft (2) or the position of at least one support (4.1), and for electrically conveying to the controller (5) of the weaving machine.

13. Weaving machine according to claim 8, characterized by a transmission element (8) for transmitting the flexure or bending displacement of the deflecting shaft (2) to the sensor (3) in such a manner so that the measuring distance (D) of the transmission element (8) effective at the sensor (3) is larger than the actual flexure or bending displacement on the deflecting shaft (2).

14. Weaving machine according to claim 13, characterized in that the transmission element (8) is equipped as a transmission lever (8) with two lever ends, wherein the first lever end is connected with a machine frame (9) of the weaving machine, while the second lever end is freely movable, and wherein the sensor (3) is arranged at a spacing distance from the deflecting shaft (2), while the transmission lever (8) is arranged between deflecting shaft (2) and sensor (3) in such a manner so that the second lever end of the transmission lever (8) lies closer to the sensor (3), while the first lever end lies closer to the deflecting shaft (2).

* * * * *